US006556140B2

(12) United States Patent
East

(10) Patent No.: US 6,556,140 B2
(45) Date of Patent: Apr. 29, 2003

(54) PROXIMITY TRANSPONDER SYSTEM

(75) Inventor: Errol Peter East, Westville (ZA)

(73) Assignee: Impro Technologies (Pty) Ltd., Pinetown (ZA)

( * ) Notice: Subject to any disclaimer, the term of this patent is extended or adjusted under 35 U.S.C. 154(b) by 63 days.

(21) Appl. No.: 09/940,995

(22) Filed: Aug. 28, 2001

(65) Prior Publication Data

US 2002/0027505 A1 Mar. 7, 2002

(30) Foreign Application Priority Data

Sep. 4, 2000 (ZA) ..... 2000/4634

(51) Int. Cl.[7] ..... G08B 13/14

(52) U.S. Cl. ..... 340/572.8; 340/572.7; 343/872

(58) Field of Search ..... 340/572.8, 572.7, 340/693.5, 551, 552, 693.6, 693.12; 343/867, 878, 866, 742, 700 R, 702, 872, 741, 748; 361/600, 679

(56) References Cited

U.S. PATENT DOCUMENTS 5,121,103 A * 6/1992 Minasy et al. ..... 340/551
5,585,811 A * 12/1996 Jetzer ..... 343/867
5,986,562 A * 11/1999 Nikolich ..... 340/693.5
6,069,564 A * 5/2000 Hatano et al. ..... 340/572.7
6,181,247 B1 * 1/2002 Bremer et al. ..... 340/572.1

* cited by examiner

*Primary Examiner*—Benjamin C. Lee

(57) ABSTRACT

The invention relates to an operating unit of a proximity transponder system. The unit has a housing of which the walls are formed predominantly of a metallic material, a space being defined in the walls in the region where the induction coil of the unit is located. This space is configured to permit magnetic flux lines to pass through the walls of the housing via the said space, thereby to permit inductive coupling with the induction coil of another operating unit. By forming the housing of predominantly a metallic material, possible tampering with the unit is greatly inhibited.

9 Claims, 1 Drawing Sheet

PROXIMITY TRANSPONDER SYSTEM

BACKGROUND OF THE INVENTION

THIS INVENTION relates to a proximity transponder system.

A proximity transponder system comprises generally two operating units, namely a proximity reader and a proximity passive transponder, where the proximity passive transponder can be interrogated by the proximity reader. This interrogation can be associated with both read-only and read/write technologies.

Such a proximity transponder system utilizes inductively coupled coils associated respectively with the reader and the transponder, firstly to provide an energy transfer from the reader coil to the transponder coil and secondly to provide a mechanism for data transmission between the reader and the transponder. By providing for an energy transfer from the reader coil to the transponder coil, the need for a separate power source for the transponder is effectively eliminated. The inductively coupled coils generally are energised by means of an AC signal with nominal signal frequencies of 125 kHz and 13.56 MHz. Insofar as the operation of a proximity transponder system of the above type, and particularly of the operating units thereof, is already well known, this is not described in further detail herein. Various applications of proximity transponder systems, including applications relating to access control systems, also are well known and are not described in further detail herein.

It is known in relation to a proximity transponder system that the inductive coupling between the coils of the reader and the transponder is sensitive to any metallic object, e.g. a metallic plate, or the like, positioned within the gap separating the two coils. The effect of a metallic object is that it causes "shorting" of flux lines, such "shorting" resulting either in inductive coupling being interfered with, or being completely prevented. For this reason, each operating unit associated with a proximity transponder system has traditionally been constrained to the use of a nonmetallic housing for the electronic components of the unit, a housing for the operating unit of a proximity transponder system thus typically being formed of a synthetic plastics material. This restriction clearly is associated with disadvantages insofar as housings of a synthetic plastics material can be relatively easily tampered with and damaged and it is thus an object of this invention to at least ameliorate this problem, particularly by permitting either one or both of a reader and a transponder as herein envisaged to be located within a metallic housing that offers the advantages of robustness and strong resistance against vandalism.

SUMMARY OF THE INVENTION

According to the invention there is provided an operating unit of a proximity transponder system, which has a housing having walls formed at least predominantly of a metallic material and in which the walls, in the location of the induction coil of the unit housed in the housing, define a space that is configured to permit magnetic flux lines to pass through the walls of the housing via the said space and thereby to permit inductive coupling with the induction coil of another operating unit.

The space defined by the walls of the housing may be an open space defined by an aperture in the said walls or, alternatively, may be a closed space defined by a wall segment of a non-metallic material of a type that will not cause "shorting" of flux lines. For the latter configuration space, the said wall segment of a non-metallic material may be formed of a synthetic plastics material.

According to one particular embodiment of the invention, the housing of the operating unit has a front wall, a spaced rear wall and a surrounding side wall extending between the front wall and the rear wall, the induction coil of the unit is located adjacent one of the walls in a substantially parallel relationship therewith and the space defines a first segment, defining a perimeter profile that coincides substantially with the perimeter of the coil, and a second segment, that extends in a slot-like fashion radially away from the first segment for a sufficient distance to avoid "shorting" of the flux lines required for inductive coupling with the induction coil of another operating unit, in use of the unit. For an induction coil located adjacent the front wall of the housing, the first segment of the space is defined within the said front wall while the second segment of the space extends to a side edge of the front wall and along the side wall towards the rear wall of the housing.

The operating unit of the invention particularly may comprise either one of a proximity reader and a proximity passive transponder, of a proximity transponder system.

The invention extends also to a housing for an operating unit of a proximity transponder system in accordance with the present invention.

The overall configuration of such a housing clearly is greatly variable and in this regard it is envisaged that different configuration housings can be associated with proximity readers and with proximity passive transponders. Such housings for proximity readers and for proximity passive transponders will be configured to permit, in combination, inductive coupling of coils carried in such housings and, as such, effective communication between proximity readers and proximity passive transponders.

BRIEF DESCRIPTION OF THE DRAWINGS

Further features of the invention are described hereafter, by way of example, with reference to the accompanying diagrammatic drawings. In the drawings.

DETAILED DESCRIPTION OF THE INVENTION

Figure 1:
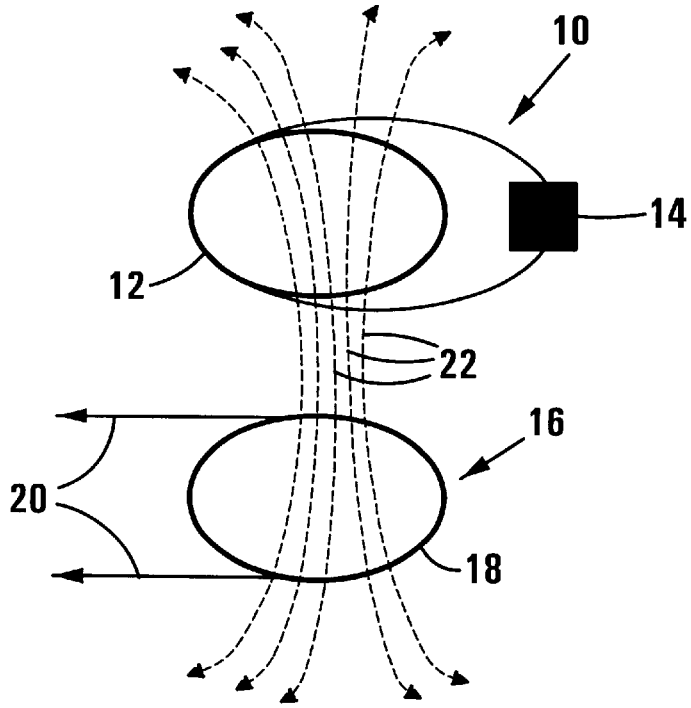
FIG. 1 illustrates schematically the operation of a proximity transponder system.

Referring initially to FIG. 1 of the drawings, a proximity transponder system includes generally a proximity passive transponder 10 having a coil 12, operatively linked with a transponder microchip 14, and a transponder reader 16 having a coil 18, operatively linked with a reader circuit via lines 20.

By the suitable positioning of the proximity passive transponder 10 with respect to the proximity reader 16, the coils 12 and 18 can be inductively coupled by flux lines 22, as is clearly illustrated, thus permitting effective communication between the transponder 10 and the reader 16 in accordance with known proximity transponder technology. Insofar as this technology is already well known, this is not described in further detail herein.

In order to ensure effective communication between the transponder 10 and the reader 16, unrestricted space through which the flux lines 22 can extend is required and in this regard it is well known that by locating a metallic object between the coils to be inductively coupled, the flux lines are "shorted" and inductive coupling is prevented thereby. As such, the transponder system will not operate, particularly because the transfer of data between the reader and the transponder will not be permitted. For the reasons set out above, it has not been possible to associate a proximity passive transponder or a proximity reader with a metallic housing within which the coils and associated circuitry and components are carried, proximity passive transponders and readers thus commonly being associated with synthetic plastics housings which do not cause "shorting" of flux lines, but which are exposed to being damaged and to being vandalised.

Figure 2:
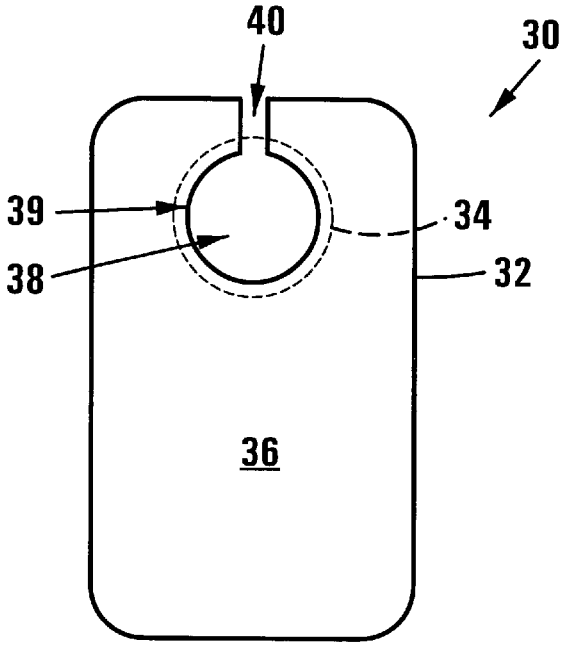
FIG. 2 shows a front view of a proximity reader of a proximity transponder system, in accordance with the invention.
Figure 3:
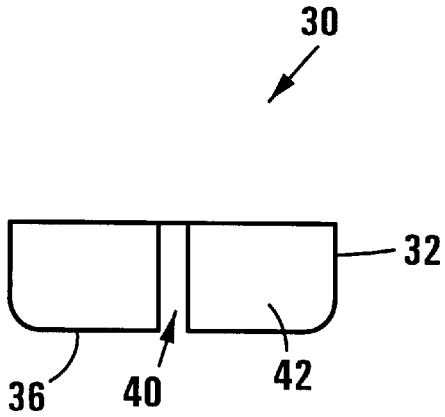
FIG. 3 shows a plan view of the proximity reader of FIG. 2.

Referring to FIGS. 2 and 3 of the drawings, a proximity reader of a proximity transponder system is designated generally by the reference numeral 30 and includes a housing 32 having walls formed of a metallic material. The housing 32 houses in particular the coil 34 (only shown in dotted lines) and other associated circuitry and components (not shown) of the reader.

The coil 34 of the reader 30 is disposed immediately adjacent the front wall 36 of the housing 32. In order to allow sufficient flux lines, for permitting inductive coupling with another coil, to pass through the walls of the housing 32, a space 38 is defined within the walls of the housing through which flux lines can pass. The space 38 is an open space providing for an air gap, or a closed space, typically filled with a synthetic plastics insert, or an insert of another non-metallic material that will not cause "shorting" of flux lines.

The space 38 includes a first segment 39 defining a perimeter profile that coincides substantially with the perimeter of the coil (as shown) and a second segment 40 that extends in a slot-like fashion radially away from the first segment, the second segment extending to the operative top edge of the housing 32 and then along the side wall 42 of the housing 32 towards the operative rear wall of the housing, as is clearly illustrated in FIGS. 2 and 3 of the drawings. The configuration of the space 38 and particularly of the first segment 39 and the second segment 40, is such that sufficient flux lines can enter into and exit from the housing 32 via the space 38, to permit inductive coupling with the coil of, for example, a proximity passive transponder, thus permitting communication between the reader 30 and the transponder.

With the housing 32 being formed predominantly of a metallic material, effecting damage to and potential vandalism of the reader will be greatly inhibited, the synthetic plastics insert defining the space 38 in the metallic walls of the housing 32 serving still further to inhibit tampering and vandalism.

It must be understood that a proximity passive transponder can be similarly associated with a metallic housing and the disadvantages associated with synthetic plastics housings for transponders and readers will thus be largely eliminated.

The overall configuration of a housing for a transponder and for a reader clearly is greatly variable and will be particularly determined by design requirements associated with the transponder system with which the transponder and the reader is to be utilized. The invention extends also to such alternative configuration metallic housings and to proximity passive transponders and proximity readers that incorporate housings that are formed predominantly of a metallic material while still permitting communication between transponders and readers, through inductive coupling of the coils thereof by flux lines passing through suitably located spaces defined by the walls of the housings.

What is claimed is:

1. An operating unit of a proximity transponder system, which has a housing having walls formed at least predominantly of a metallic material and in which the walls, in the location of the induction coil of the unit housed in the housing, define a space that is configured to permit magnetic flux lines to pass through the walls of the housing via the said space and thereby to permit inductive coupling with the induction coil of another operating unit.

2. An operating unit as claimed in claim 1, in which the space defined by the walls of the housing is an open space defined by an aperture in the walls.

3. An operating unit as claimed in claim 2, in which the housing has a front wall, a spaced rear wall and a surrounding side wall extending between the front wall and the rear wall, the induction coil of the unit is located adjacent one of the walls in a substantially parallel relationship therewith and the space defines a first segment, defining a perimeter profile that coincides substantially with the perimeter of the coil, and a second segment, that extends in a slot-like fashion radially away from the first segment for a sufficient distance to avoid "shorting" of the flux lines required for inductive coupling with the inductive coil of another operating unit, in use of the unit.

4. An operating unit as claimed in claim 3, in which the induction coil of the unit is located adjacent the front wall of the housing and the first segment of the space is defined within the said front wall while the second segment of the space extends to a side edge of the front wall and along the side wall towards the rear wall of the housing.

5. An operating unit as claimed in claim 1, in which the space defined by the walls of the housing is a closed space defined by a wall segment of a non-metallic material of the type that will not cause "shorting" of flux lines.

6. An operating unit as claimed in claim 5, in which the non-metallic material forming the wall segment is of a synthetic plastics material.

7. An operating unit as claimed in claim 1, which comprises a proximity reader of a proximity transponder system.

8. An operating unit as claimed in claims 1, which comprises a proximity passive transponder of a proximity transponder system.

9. A housing for an operating unit of a proximity transponder system as claimed in claim 1.

* * * * *